US006510628B1

(12) United States Patent
Koch

(10) Patent No.: US 6,510,628 B1
(45) Date of Patent: Jan. 28, 2003

(54) METHOD AND APPARATUS FOR DETERMINING A CONTACT FORCE OF A WORK TOOL

(75) Inventor: Roger D. Koch, Pekin, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/004,232

(22) Filed: Oct. 31, 2001

(51) Int. Cl.[7] ..... E02F 3/34; G06F 19/00

(52) U.S. Cl. ..... 37/348; 37/414; 37/195; 701/50; 172/2

(58) Field of Search ..... 37/414, 416, 348, 37/195; 701/50; 172/2, 4.5; 414/699

(56) References Cited

U.S. PATENT DOCUMENTS 5,065,326 A 11/1991 Sahm
5,446,980 A 9/1995 Rocke
5,461,803 A 10/1995 Rocke
5,493,798 A 2/1996 Rocke et al.
5,528,843 A 6/1996 Rocke
5,682,312 A 10/1997 Rocke
5,974,352 A 10/1999 Shull

*Primary Examiner*—Christopher J. Novosad
(74) *Attorney, Agent, or Firm*—Steve D Lundquist

(57) ABSTRACT

A method and apparatus for determining a force of a work tool as the work tool contacts a surface. The method and apparatus includes determining at least one non-contact force exerted on the work tool, determining a calibration factor as a function of the at least one non-contact force, determining a contact being made between the work tool and the surface, and determining the contact force of the work tool with the surface as a function of the contact being made and the calibration factor.

21 Claims, 7 Drawing Sheets

FORCE - N
VERTICAL FORCE AT WORK TOOL
1000
800
600
400
200
0
-200
FORCE – N
502
LIFT CYL FORCE - N
LIFT CYLINDER PRESSURE
72000
71000
70000
69000
68000
67000
66000
65000
64000
LIFT CYL FORCE - N
0
2
4
6
8
10
12
14
TIME (SEC)
504

METHOD AND APPARATUS FOR DETERMINING A CONTACT FORCE OF A WORK TOOL

TECHNICAL FIELD

This invention relates generally to a method and apparatus for determining a force of a work tool as the work tool contacts a surface and, more particularly, to a method and apparatus for compensating for non-contact forces of the work tool to more accurately determine a contact force of a work tool.

BACKGROUND

Work tools are used in many situations in which it is desired to contact a surface in a carefully controlled manner. If too little force is applied upon contact, the work performed may be inefficient and non-productive. On the other hand, if too much force is applied, the surface being worked on, as well as the work tool itself, may be damaged.

Examples of work tools which must contact a surface to perform the desired work abound in many industries. For example, manufacturing and machining must use surface contacting work tools throughout the processes. The construction and earthworking industries must also use various types of surface contacting work tools. Service industries, such as industrial and commercial cleaning and maintenance, also employ different types of work tools which must contact surfaces to function.

Taking the construction and earthworking industries into consideration for exemplary purposes, work tools are often connected to work machines by way of controllable linkage assemblies. For example, wheel loaders and backhoe loaders are work machines which may use any of several different work tools, such as buckets, rollers, sweepers, and the like. These work tools must be used so that they contact a surface, e.g., a road, the ground and such, with certain desired forces. As a specific example, a wheel loader or backhoe loader having a sweeper attachment as a work tool must control the sweeper so that contact forces do not exceed desired limitations. The application of excessive force damages the work tool, thus resulting in costly loss of productive time.

Although the application of the proper force as the work tool contacts a surface is highly desired and necessary, it is quite difficult for an operator of a work machine, or even for typical automated processes, to accurately control the amount of force applied to the work tool as it contacts a surface. Furthermore, the required control of the force applied is very difficult to achieve at the moment of time that the work tool initiates contact with the surface. More specifically, it is difficult to monitor the force applied to a work tool and responsively determine the instant of time that the work tool contacts a surface so that control of the contact force takes place at the moment of contact.

The present invention is directed to overcoming one or more of the problems as set forth above.

SUMMARY OF THE INVENTION

In one aspect of the present invention a method for determining a contact force of a work tool is disclosed. The method includes the steps of determining at least one non-contact force exerted on the work tool, determining a calibration factor as a function of the at least one non-contact force, determining a contact being made between the work tool and a surface, and determining the contact force of the work tool with the surface as a function of the contact being made and the calibration factor.

In another aspect of the present invention an apparatus for determining a contact force of a work tool with a surface, the work tool being controllably attached to a linkage assembly, the linkage assembly being controllably attached to a work machine, is disclosed. The apparatus includes at least one actuator for controllably moving the linkage assembly and the work tool relative to the work machine, means for determining a force exerted on the work tool, and a controller for receiving a signal from the means for determining a force and responsively determining at least one non-contact force exerted on the work tool, determining a calibration factor as a function of the at least one non-contact force, determining a contact being made between the work tool and the surface, and determining the contact force of the work tool with the surface as a function of the contact being made and the calibration factor.

DETAILED DESCRIPTION

Figure 1:
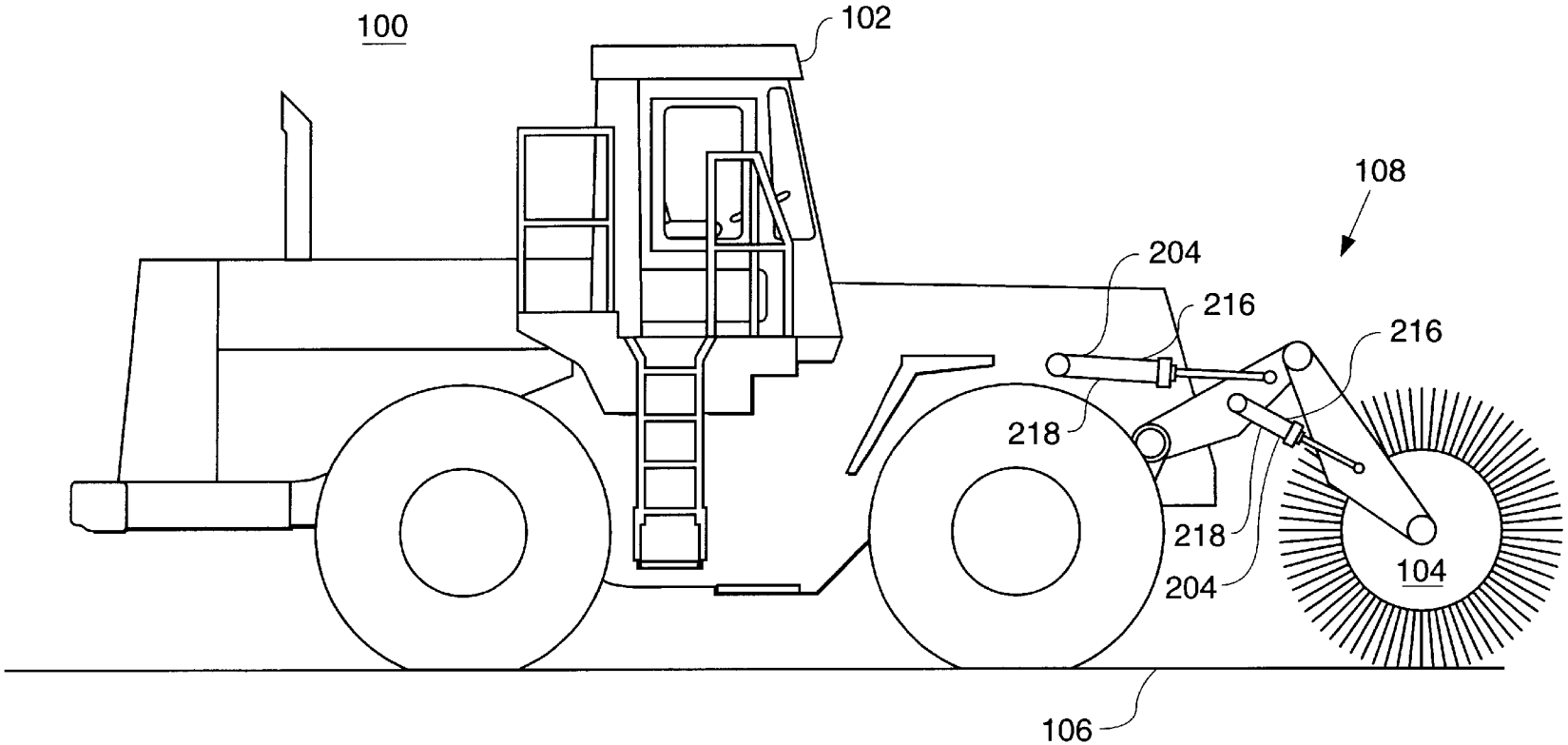
FIG. 1 is a diagrammatic illustration of a work machine having a work tool attached.

Referring to the drawings, a method and apparatus 100 for determining a contact force of a work tool 104 with a surface 106 is shown. With particular reference to FIG. 1, a work machine 102 includes a work tool 104 controllably attached by a linkage assembly 108.

The work tool 104 depicted in FIG. 1 is a broom, typically used to sweep a surface 106. The present invention is ideally suited for use with a broom as a work tool 104, since the amount of force by which the broom contacts the surface 106 must be controlled to close tolerances. If the contact force is too light, the broom does not function efficiently. However, if the broom contact force is too high, damage might result to the broom. It is noted, however, that various other types of work tools may also benefit from the present invention. For example, buckets, blades, scrapers, drills, hammers, compactor wheels, rakes, plows, furrows, and the like form a partial list of tools which may use the present invention.

The work machine 102 of FIG. 1 is shown to resemble a typical wheel loader or backhoe loader type of machine. Wheel loaders and backhoe loaders commonly are designed to use multiple types of work tools, such as the broom shown in FIG. 1. However, other types of work machines, e.g., excavators, shovels, trucks, tractors, dozers, and the like, may be used as well. Furthermore, the work machine 102 may not be a mobile type of machine, i.e., having wheels or tracks and a means for propulsion. For example, the work machine 102 may be at a fixed location, such as at a manufacturing plant or assembly line, and may be used to control the application of the work tool 104 at that fixed location.

The linkage assembly 108 controllably connects the work tool 104 to the work machine 102. For example, as shown in FIG. 1, the linkage assembly 108 may be used to controllably lift and lower the work tool 104 relative to the surface 106. The linkage assembly 108 may also be used to controllably move the work tool 104 in other directions as well. For example, the linkage assembly 108 of an excavator may be used to move the work tool 104, e.g., a bucket, in a multitude of directions.

The surface 106 may be the ground, pavement, or some material being worked on by the work tool 104. Additionally, the surface 106 is not limited to a horizontal surface upon which the work machine 102 travels, as shown in FIG. 1. The surface 106 may be at a different plane of existence than the plane upon which the work machine 102 rests. For example, in a manufacturing environment, the work machine 102 might rest on the ground, but the surface 106 of interest, i.e., the surface 106 being worked on, might be at some level other than ground level. Furthermore, the surface 106 might not be on a horizontal plane. For example, an excavator or backhoe loader digging a trench or hole might need to contact a side wall of the trench or hole with a desired level of force to avoid caving-in the side wall.

Figure 2:
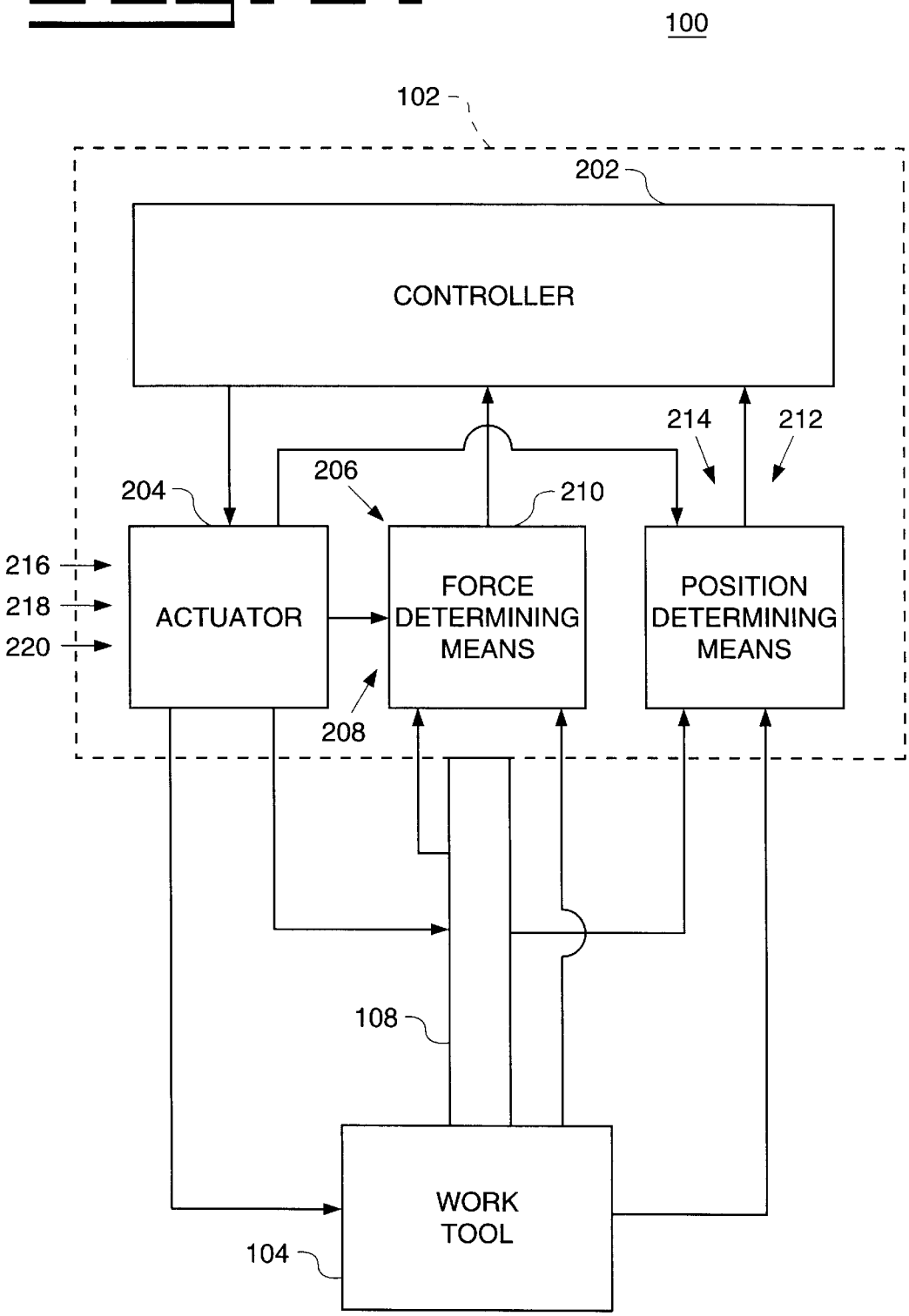
FIG. 2 is a block diagram illustrating a preferred embodiment of the present invention.

Referring to FIG. 2, a block diagram illustrating a preferred embodiment of the present invention is shown.

A controller 202, preferably located on the work machine 102, but alternatively located at a remote site, receives information, processes the information, makes determinations, and provides control capabilities. In the preferred embodiment, the controller 202 is microprocessor-based. For example, the controller may include a microprocessor of a type well known in the art. The function of the controller 202 is described in more detail below.

At least one actuator 204, located on the work machine 102, controllably moves the linkage assembly 108 and the work tool 104 relative to the work machine 102. Preferably, the at least one actuator 204 is controlled by commands received from the controller 202. However, the at least one actuator 204 may also be controlled manually, i.e., by a human operator. In one embodiment, the at least one actuator 204 may include at least one hydraulic actuator 216. The at least one hydraulic actuator 216 would preferably include at least one hydraulic cylinder 218. In another embodiment, the at least one actuator 204 may include at least one electric actuator 220. Other types of actuators may be used as well. For example, pneumatic, mechanical, and the like types of actuators may be used with the present invention. It is noted that various combinations of the above mentioned types of actuators may be used. In the example of FIG. 1, the work tool 104 and the linkage assembly 108 is controllably moved by hydraulic cylinders 218, as is well known in the art for hydraulic work machines.

Means 206 for determining a force exerted on the work tool 104 is configured to determine the force and deliver the determined force information to the controller 202. In the preferred embodiment, the means 206 for determining a force exerted on the work tool 104 includes means 208 for determining a force on an actuator 204. More specifically, the means 208 for determining a force on an actuator 204 preferably includes at least one pressure sensor 210. In the embodiment in which the actuator is a hydraulic cylinder 218, the pressure sensor 210 senses hydraulic pressure created as the hydraulic cylinder 218 works to position and move the linkage assembly 108 and the work tool 104.

It is noted that the force exerted on the work tool 104 includes both contact and non-contact forces. Contact forces include forces exerted as the work tool 104 contacts the surface 106. Non-contact forces include, but are not limited to, forces caused by gravity, friction, and inertia. These non-contact forces may vary with conditions such as the position of the work tool 104 and the linkage assembly 108, the velocity of movement of the work tool 104, foreign material (such as dirt, rocks, and such) adhering to the work tool 104, and the like. The present invention, as described below, compensates for the non-contact forces so that monitoring of the contact forces may be performed more accurately and reliably.

At least one position determining means 212, preferably located on the work machine 102, determines the position of at least one of the linkage assembly 108 and the work tool 104, and delivers this position information to the controller 202. In the preferred embodiment, the at least one position determining means 212 includes means 214 for determining a position of the at least one actuator 204. For example, if an actuator 204 is a hydraulic cylinder 218, the means 214 for determining a position may be a sensor suited for sensing a displacement of the hydraulic cylinder 218. Such cylinder position sensors are well known in the art.

Other devices for determining position of the work tool 104 may be used without deviating from the spirit of the present invention. For example, the position of the work tool 104 may be determined by using a position determining technology such as GPS, laser, resolvers, or some other type.

Figure 3:
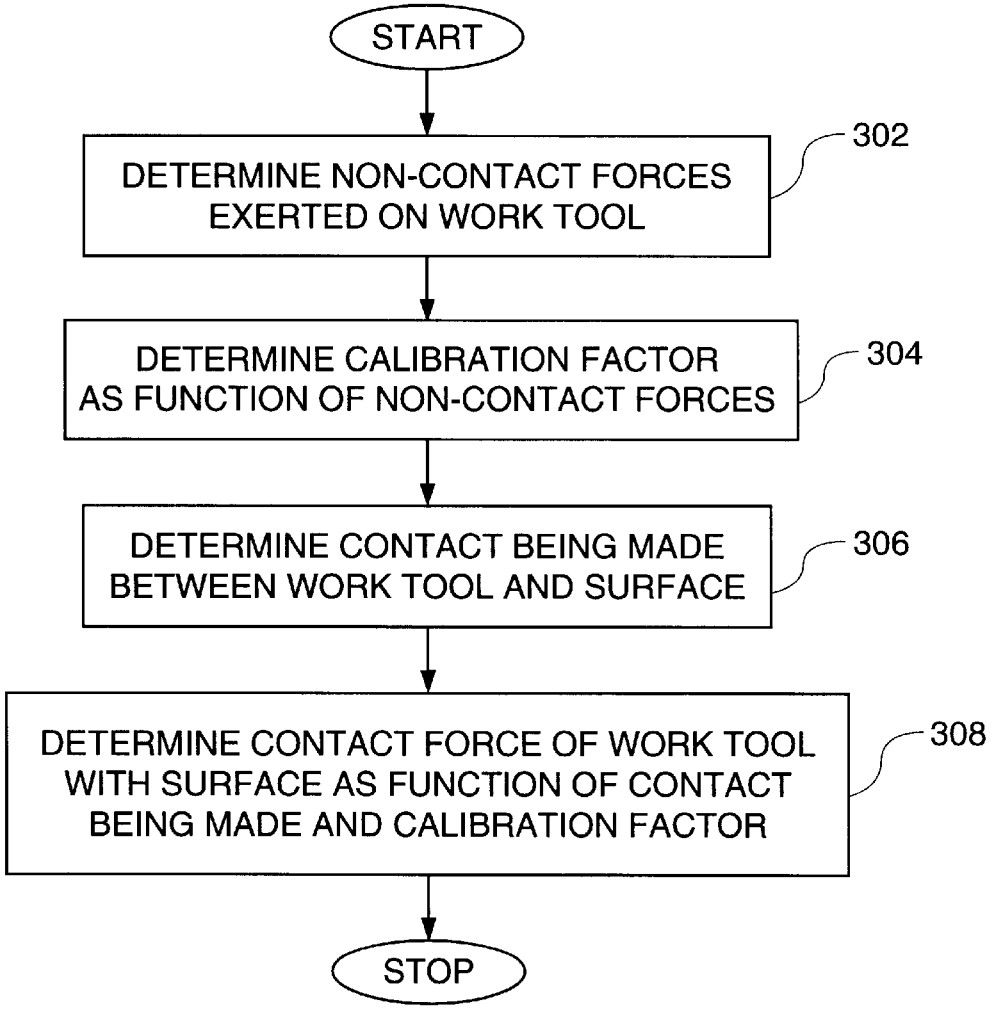
FIG. 3 is a flow diagram illustrating a preferred aspect of a method of the present invention.

Referring to FIG. 3, a flow diagram illustrating one aspect of a preferred method of the present invention is shown.

In a first control block 302, at least one non-contact force exerted on the work tool 104 is determined. Non-contact forces, as described above, include forces caused by gravity, friction, inertia, and the like. In a second control block 304, a calibration factor is determined as a function of the at least one non-contact force.

Preferably, the steps defined in first and second control blocks 302,304 are performed as shown in the flow diagram of FIG. 4, and as described below.

Figure 4:
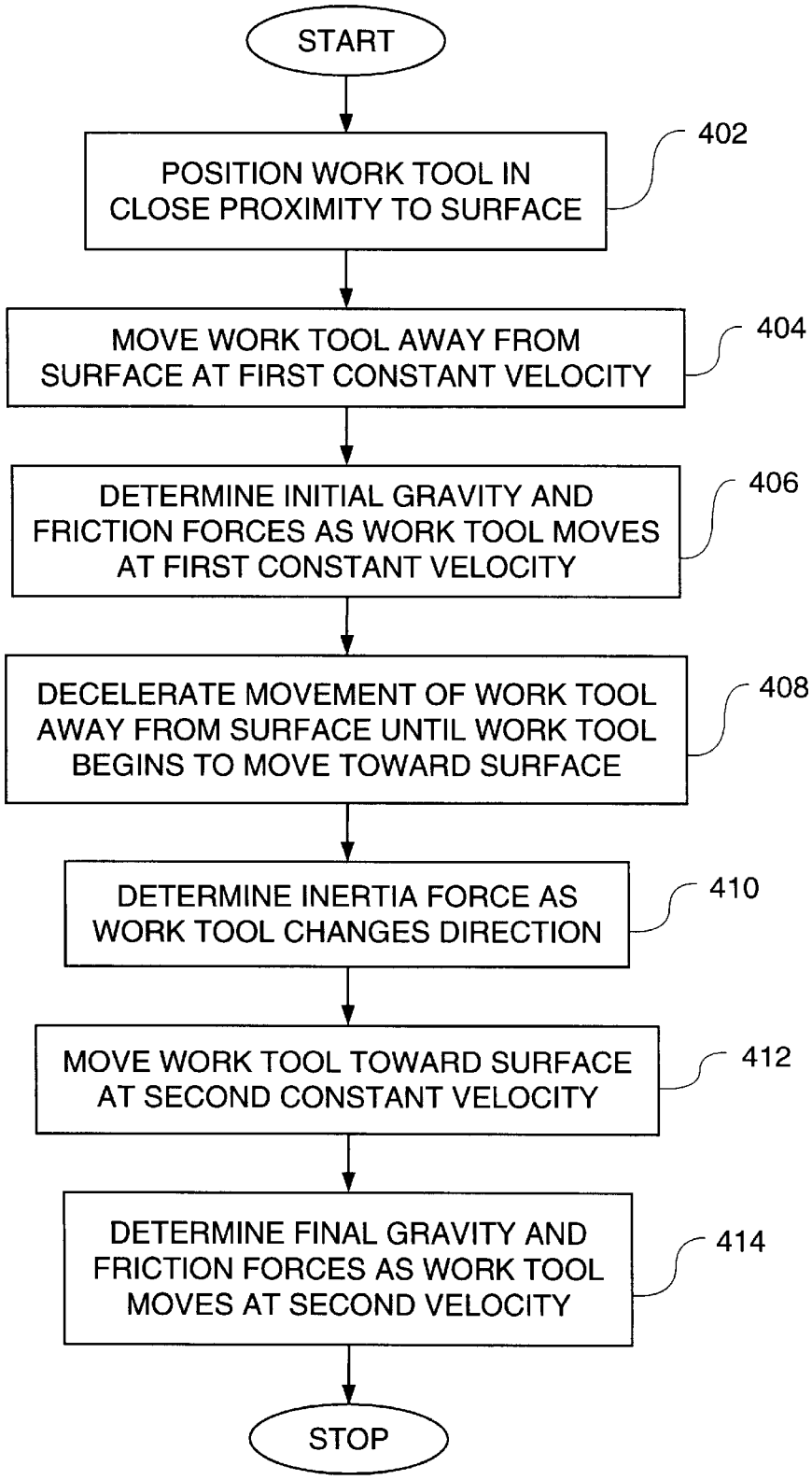
FIG. 4 is a flow diagram illustrating another preferred aspect of a method of the present invention.

In a first control block 402 in FIG. 4, the work tool 104 is positioned in close proximity to the surface 106. Preferably, this step is performed by a human operator in a manual mode. However, the step could be performed automatically using proximity sensors such as acoustic sensors and such.

In the preferred embodiment, the remaining steps in FIG. 4 are performed automatically. More specifically, the operator initiates the sequence and the controller 202 controls the work tool 104 and the linkage assembly 108 to perform the remaining steps.

In a second control block 404, the work tool 104 is moved away from the surface 106 at a first constant velocity. In the configuration of FIG. 1, the work tool 104 would move in an upwards direction away from the surface 106. However, the direction of movement of the work tool 104 may not necessarily be upwards. For example, a bucket of an excavator digging a hole or trench may need to move horizontally to move away from the surface 106, i.e., the side of the hole or trench.

In a third control block 406, an initial value of gravity and friction forces are determined as the work tool 104 moves at the first constant velocity.

In a fourth control block 408, the movement of the work tool 104 decelerates until the motion of the work tool 104 changes direction and the work tool 104 begins to move toward the surface 106. During this time control proceeds to a fifth control block 410, in which inertia forces of the work tool 104 are determined as the work tool 104 changes direction.

In a sixth control block 412, the work tool 104 is moved toward the surface 106 at a second constant velocity. During this time, in a seventh control block 414, a final set of values of gravity and friction forces are determined. Preferably, the final values of gravity and friction forces are more accurate iterations of the initial set of gravity and friction force determinations. It is noted that the first constant velocity and the second constant velocity may be equal in value or may be two separate velocity values.

Figure 6:
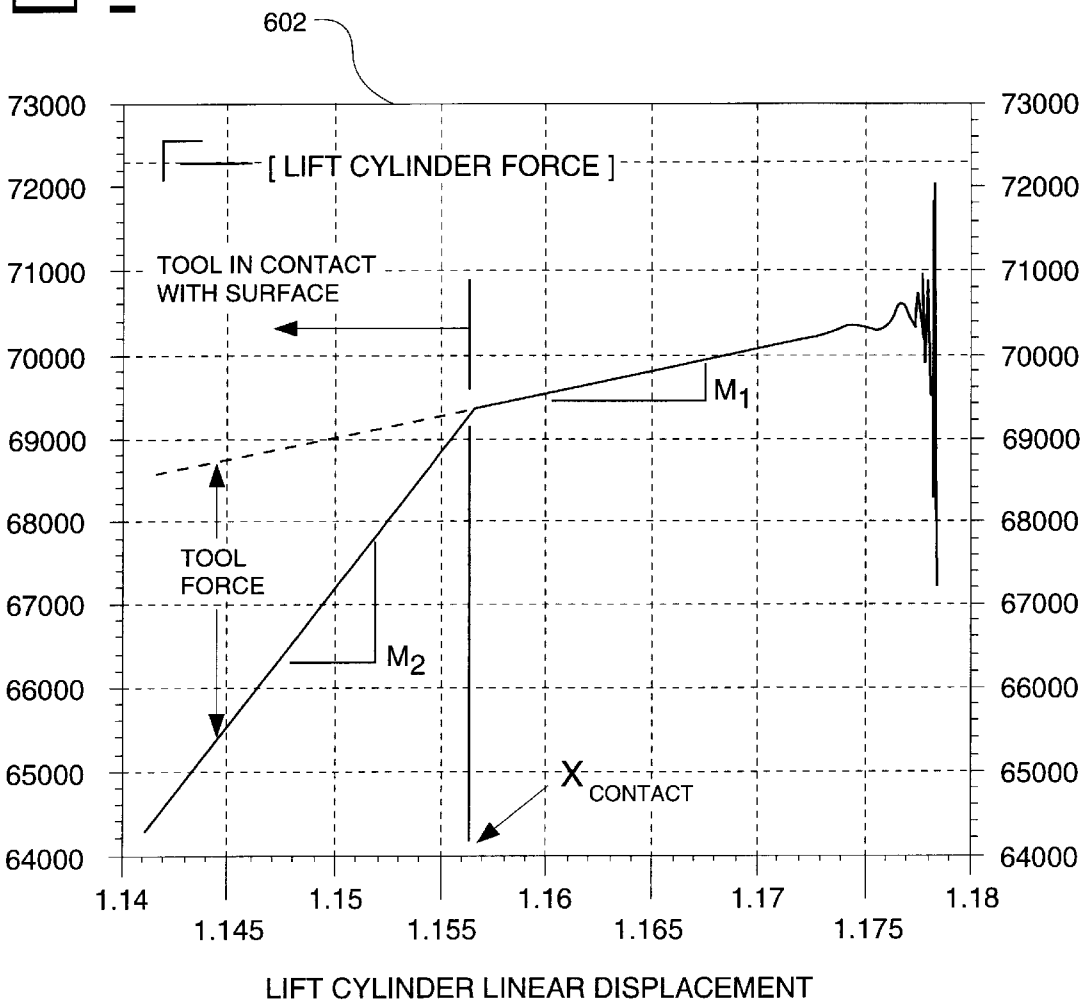
FIG. 6 is a diagrammatic illustration of a third graph depicting further aspects of the present invention.

In the typical situation in which the forces determined are forces on the actuator 204, the position and geometry of the linkage assembly 108 must be taken into account to determine the forces exerted on the work tool 104. One such method for performing this force translation uses the following equation:

$$F_{tool} = \frac{(F_{cyl} - (M_1 * (X_{lift} - X_{contact}) + F_{contact}))}{K_1} \quad \text{(Eq. 1)}$$

where $M_1$ is the slope of the hydraulic cylinder force curve during non-contact, as shown in FIG. 6 and described below, and $K_1$ is the calibration factor, expressed as:

$$K_1 = \frac{(F_{cyl} - F_{freespace})}{F_{tool}}. \quad \text{(Eq. 2)}$$

Figure 5:
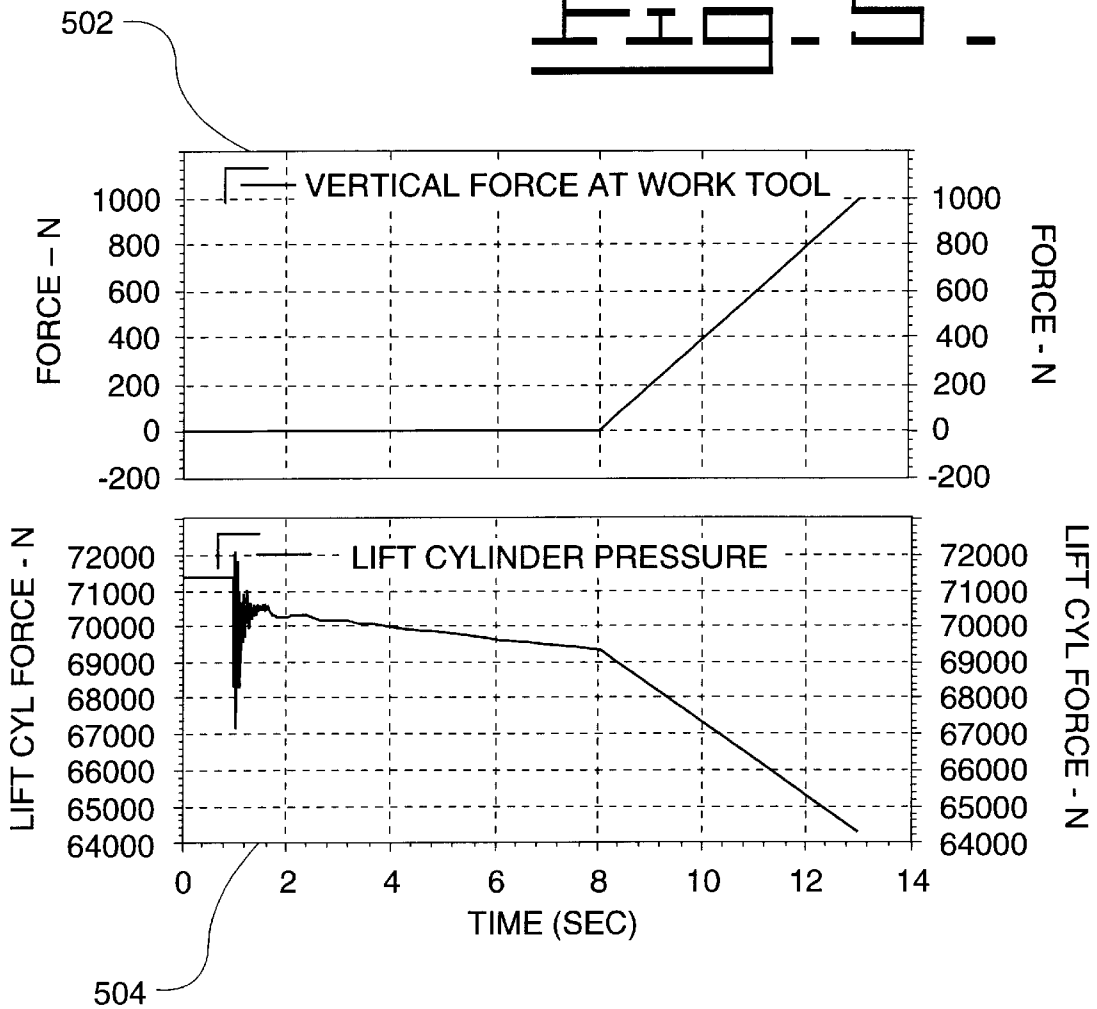
FIG. 5 is a diagrammatic illustration of a first and a second graph depicting aspects of the present invention.

Referring back to FIG. 3, in a third control block 306, a determination is made at the moment the work tool 104 contacts the surface. This moment of contact is determined by a change in force of the work tool 104. More specifically, the moment of contact is determined by a change in force or pressure on the at least one actuator 204. Referring to FIG. 5, a first graph 502 and a second graph 504 serve to illustrate the work tool 104 contacting the surface 106. In the first graph 502, the force of the work tool 104 is at zero, i.e., the non-contact forces are compensated for, until a time 8 seconds. At that time, the work tool force begins to increase, thus indicating that contact with the surface 106 has occurred. At the same time, in the second graph 504, the pressure applied to the hydraulic cylinder 218 begins to decrease at a more rapid rate, i.e., the slope increases, thus indicating that contact with the surface 106 has relieved the hydraulic cylinder 218 of some pressure since the work tool 104 is no longer being held in free space.

FIG. 6 illustrates a third graph which shows the force applied to a hydraulic cylinder 218 as a function of the linear displacement of the cylinder 218. From the left of the graph, the work tool 104 is in free space and the slope of the graph is depicted as $M_1$. However, as the cylinder 218 displaces to about 1.156 (units not used), the slope increases to $M_2$, thus indicating that the work tool 104 has contacted the surface 106.

Figure 7:
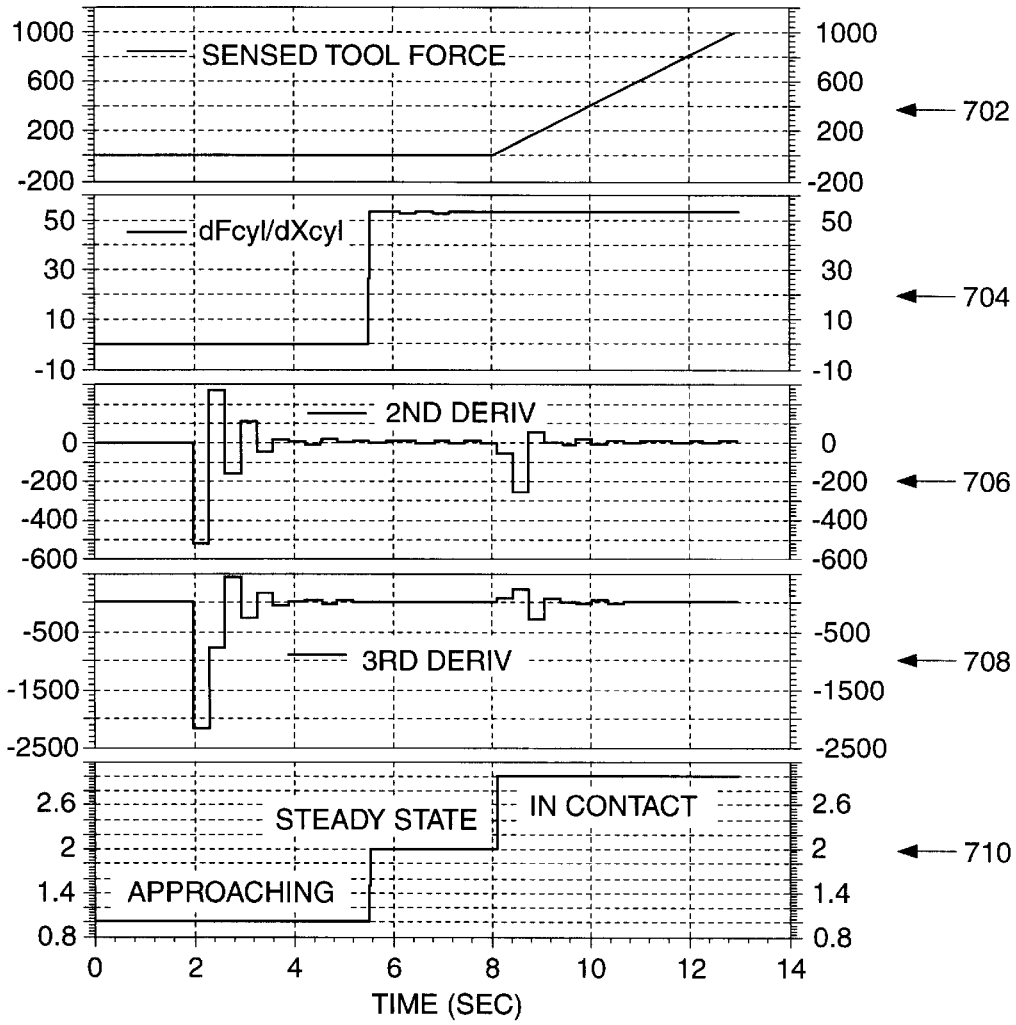
FIG. 7 is a diagrammatic illustration of fourth, fifth, sixth, seventh and eighth graphs depicting still further aspects of the present invention.

It is often difficult to determine exactly when the work tool 104 contacts the surface 106. First, the change in force at the exact moment of contact is very small, and it is often desired to detect a very slight change in force to more quickly and accurately control the force of the work tool 104 on the surface 106. Second, under normal operating conditions, many transient forces exist, thus making it difficult to determine the exact moment of contact. FIG. 7 illustrates a series of graphs which show a preferred method for determine the moment of contact.

A fourth graph 702 plots the change in force of the work tool 104 as it contacts the surface 106 at about a time 8 seconds. A fifth graph 704 shows a plot of a first derivative of force with respect to cylinder displacement. A sixth graph 706 shows a plot of a second derivative, and a seventh graph 708 shows a plot of a third derivative. The second and third derivatives are used to determine the moment of contact. The second and third derivatives each have a steady state threshold below which the change of force with respect to cylinder displacement is assumed to have reached steady state. After the pressure sensor 210 has reached steady state, if the second or third derivatives exceed the contact trigger levels, the work tool 104 is assumed to have made contact with the surface 106. An eighth graph 710 shows a plot of steady state conditions as determined by the second and third derivatives.

Referring again to FIG. 3, in a fourth control block 308, the contact force of the work tool 104 with the surface 106 is determined as a function of contact being made and the calibration factor, as described above.

INDUSTRIAL APPLICABILITY

As an example of an application of the present invention, the work tool 104 of FIG. 1 is shown as a broom attachment on a work machine 102, typically a wheel loader or an backhoe loader. Care must be taken when making contact between the broom and the surface 106 since the broom may easily be damaged by excessive force upon contact. In addition, it may be desired to vary the amount of force applied. For example, it may be desired to modulate the force of contact as a function of the rotational speed of the broom to optimize the effectiveness of the broom.

It becomes difficult to determine and monitor the contact force of the broom effectively since various non-contact forces tend to distort the determination of the contact force. In particular, the non-contact forces may themselves vary over time. For example, the accumulation of dirt and debris on the tines of the broom change the weight of the broom and thus change forces due to gravity. In addition, other forces such as friction and inertia change over time and under various operating conditions. These uncertainties in the value of non-contact forces make the determination of the desired contact forces very difficult.

Other aspects, objects, and features of the present invention can be obtained from a study of the drawings, the disclosure, and the appended claims.

What is claimed is:

1. A method for determining a contact force of a work tool, including the steps of:

determining at least one non-contact force exerted on the work tool;

determining a calibration factor as a function of the at least one non-contact force;

determining a contact being made between the work tool and a surface; and determining the contact force of the work tool with the surface as a function of the contact being made and the calibration factor.

2. A method, as set forth in claim 1, wherein determining a calibration factor includes the steps of:

positioning the work tool in close proximity to the surface; and initiating a sequence of steps for determining the calibration factor.

3. A method, as set forth in claim 2, wherein initiating a sequence of steps includes the step of initiating an automated sequence of steps.

4. A method, as set forth in claim 3, wherein the automated sequence of steps includes the steps of:

moving the work tool away from the surface at a first constant velocity;

determining an initial at least one of gravity and friction forces as the work tool moves at the first constant velocity;

decelerating the movement of the work tool away from the surface until the work tool begins to move toward the work surface;

determining an inertia force as the work tool changes direction from moving away from the work surface to moving toward the work surface;

moving the work tool toward the surface at a second constant velocity; and determining a final at least one of gravity and friction forces as the work tool moves at the second constant velocity.

5. A method, as set forth in claim 1, wherein determining at least one non-contact force includes the step of calculating at least one of a second force derivative and a third force derivative of the at least one non-contact force on the work tool as the work tool moves.

6. A method, as set forth in claim 5, wherein determining a contact being made between the work tool and the surface includes the step of determining a contact being made between the work tool and the surface as a function of the at least one of the second and third force derivatives.

7. A method, as set forth in claim 1, wherein determining the contact force of the work tool with the surface includes the steps of:

determining a total force of the work tool; and removing the at least one non-contact force from the total force as a function of the calibration factor.

8. A method, as set forth in claim 1, further including the step of maintaining the contact force of the work tool at a desired contact force.

9. A method for determining a contact force of a work tool with a surface, including the steps of:

positioning the work tool in close proximity to the surface;

initiating a sequence of steps for determining at least one non-contact force on the work tool, and for determining a calibration factor as a function of the at least one non-contact force;

determining an occurrence of a contact being made by the work tool with the surface; and determining the contact force of the work tool with the surface as a function of the contact being made and the calibration factor.

10. A method, as set forth in claim 9, wherein initiating a sequence of steps includes the step of initiating an automated sequence of steps, and wherein the automated sequence of steps includes the steps of:

moving the work tool away from the surface at a first constant velocity;

determining an initial at least one of gravity and friction forces as the work tool moves at the first constant velocity;

decelerating the movement of the work tool away from the surface until the work tool begins to move toward the work surface;

determining an inertia force as the work tool changes direction from moving away from the work surface to moving toward the work surface;

moving the work tool toward the surface at a second constant velocity; and determining a final at least one of gravity and friction forces as the work tool moves at the second constant velocity.

11. A method, as set forth in claim 10, wherein the sequence of steps for determining at least one non-contact force includes the step of calculating at least one of a second force derivative and a third force derivative of the at least one non-contact force on the work tool as the work tool moves; and wherein determining an occurrence of a contact being made by the work tool with the surface includes the step of determining a contact being made by the work tool with the surface as a function of the at least one of the second and third force derivatives.

12. A method for determining a contact force of a work tool, including the steps of:

determining at least one non-contact force exerted on the work tool;

determining a calibration factor as a function of the at least one non-contact force;

calculating at least one of a second force derivative and a third force derivative of the at least one non-contact force on the work tool as the work tool moves toward a surface;

determining a contact being made between the work tool and the surface as a function of the at least one of the second and third force derivatives; and determining the contact force of the work tool with the surface as a function of the contact being made and the calibration factor.

13. A method, as set forth in claim 12, wherein determining a calibration factor includes the steps of:

positioning the work tool in close proximity to the surface; and initiating an automated sequence of steps for determining the calibration factor.

14. An apparatus for determining a contact force of a work tool with a surface, the work tool being controllably attached to a linkage assembly, the linkage assembly being controllably attached to a work machine, comprising:

at least one actuator for controllably moving the linkage assembly and the work tool relative to the work machine;

means for determining a force exerted on the work tool; and a controller for receiving a signal from the means for determining a force and responsively;

determining at least one non-contact force exerted on the work tool;

determining a calibration factor as a function of the at least one non-contact force;

determining a contact being made between the work tool and the surface; and determining the contact force of the work tool with the surface as a function of the contact being made and the calibration factor.

15. An apparatus, as set forth in claim 14, wherein the means for determining a force exerted on the work tool includes means for determining a force exerted on the at least one actuator.

16. An apparatus, as set forth in claim 15, wherein the means for determining a force includes at least one pressure sensor.

17. An apparatus, as set forth in claim 14, further including at least one position determining means for determining a position of at least one of the linkage assembly and the work tool.

18. An apparatus, as set forth in claim 17, wherein the at least one position determining means includes means for determining a position of the at least one actuator.

19. An apparatus, as set forth in claim 14, wherein the at least one actuator includes at least one hydraulic actuator.

20. An apparatus, as set forth in claim 19, wherein the at least one hydraulic actuator includes at least one hydraulic cylinder.

21. An apparatus, as set forth in claim 14, wherein the at least one actuator includes at least one electric actuator.

* * * * *